US006327735B1

(12) United States Patent
Krämer

(10) Patent No.: US 6,327,735 B1
(45) Date of Patent: Dec. 11, 2001

(54) POWER TIP TOOTHBRUSH WITH BALL JOINT

(75) Inventor: Hans Krämer, Buehl-Altschweier (DE)

(73) Assignee: SmithKline Beecham Consumer Healthcare, GmbH, Buhl (DE)

( * ) Notice: Subject to any disclaimer, the term of this patent is extended or adjusted under 35 U.S.C. 154(b) by 0 days.

(21) Appl. No.: 09/380,013

(22) PCT Filed: Feb. 17, 1998

(86) PCT No.: PCT/EP98/00955

§ 371 Date: Aug. 24, 1999

§ 102(e) Date: Aug. 24, 1999

(87) PCT Pub. No.: WO98/37788

PCT Pub. Date: Sep. 3, 1998

(30) Foreign Application Priority Data

Feb. 24, 1997 (GB) ..... 97301184

(51) Int. Cl.[7] ..... A46B 9/04
(52) U.S. Cl. ..... 15/167.1; 15/172; 4/104
(58) Field of Search ..... 15/167.1, 172; D4/104

(56) References Cited

U.S. PATENT DOCUMENTS

| | | | |
|---|---|---|---|
| D. 200,395 | | 2/1965 | Brennesholtz . |
| D. 302,492 | | 8/1989 | Embasz . |
| D. 365,209 | * | 12/1995 | Plummer ..... D4/104 |
| 759,490 | | 5/1904 | Yates . |
| 914,501 | | 3/1909 | McEachern . |
| 1,327,807 | | 1/1920 | Burleigh . |
| 1,466,723 | | 9/1923 | Izawa . |
| 1,924,337 | | 8/1933 | Troupa . |
| 1,927,365 | | 9/1933 | Frolio . |
| 1,928,328 | | 9/1933 | Carpenter . |
| 2,003,243 | | 5/1935 | Campbell et al. . |
| 2,172,624 | | 9/1939 | Robert . |
| 2,254,365 | | 9/1941 | Griffith et al. . |

(List continued on next page.)

FOREIGN PATENT DOCUMENTS

| | | |
|---|---|---|
| 508048 | 12/1954 | (CA) . |
| 508049 | 12/1954 | (CA) . |
| 520692 | 1/1956 | (CA) . |
| 460 705 | 8/1968 | (CH) . |
| 393 882 | 6/1923 | (DE) . |
| 1 233 821 | 2/1967 | (DE) . |
| 2 500 132 | 7/1976 | (DE) . |
| 353 949 | 12/1979 | (DE) . |
| 3 628 722 | 2/1988 | (DE) . |
| 3 737 223 | 5/1989 | (DE) . |

(List continued on next page.)

OTHER PUBLICATIONS

RAPRA Information Services, Alathon Search, 1972–1999, pp. 1–16.
European Opposition and Prosecution History (with index). Preliminary Injunction Pleadings filed by SmithKline Beechman Preliminary Injunction Pleadings field by Colgate–Palmolive.

*Primary Examiner*—Terrence R. Till
(74) *Attorney, Agent, or Firm*—Nora Stein-Fernandez; Stephen Venetianer; Charles M. Kinzig

(57) ABSTRACT

A toothbrush in which the head comprises a substantially rigid base region adjoining the toothbrush neck and extending from the base end of the head to a resilient flexible link situated between the base end and the tip end, and a tip region extending from the tip end of the head to the link region, both the base region and tip region being bristle bearing, the tip region being flexibly and resiliently linked at the link region to the base region, and between the base end of the head and the neck there is a resilient flexible link.

16 Claims, 4 Drawing Sheets

U.S. PATENT DOCUMENTS

| | | | | |
|---|---|---|---|---|
| 2,266,195 | | 12/1941 | Hallock . | |
| 2,438,268 | | 3/1948 | Bressler . | |
| 2,443,297 | | 6/1948 | Bressler . | |
| 2,631,320 | | 3/1953 | Bressler . | |
| 2,650,383 | | 9/1953 | Bressler . | |
| 2,676,350 | | 4/1954 | Bressler . | |
| 2,685,703 | | 8/1954 | Dellenbach . | |
| 2,722,031 | | 11/1955 | Bressler . | |
| 2,730,747 | | 1/1956 | Bressler . | |
| 2,807,820 | | 10/1957 | Dinhofer . | |
| 2,864,111 | | 12/1958 | Rotceig . | |
| 3,000,030 | | 9/1961 | Ours . | |
| 3,152,349 | | 10/1964 | Brennesholtz . | |
| 3,188,672 | | 6/1965 | Gary . | |
| 3,253,292 | | 5/1966 | Herschensohn . | |
| 3,493,991 | | 2/1970 | DeBianchi . | |
| 3,616,170 | | 10/1971 | Closson, Jr. . | |
| 3,805,986 | | 4/1974 | Gaudin . | |
| 3,821,333 | | 6/1974 | Goodwin et al. . | |
| 3,992,958 | | 11/1976 | Bonnefon . | |
| 4,263,691 | | 4/1981 | Pakarnseree . | |
| 4,488,328 | | 12/1984 | Hyman . | |
| 4,520,526 | | 6/1985 | Peters . | |
| 4,575,894 | | 3/1986 | Stevens et al. . | |
| 4,691,405 | | 9/1987 | Reed . | |
| 4,712,267 | | 12/1987 | Cheng . | |
| 5,052,071 | | 10/1991 | Halm . | |
| 5,054,154 | | 10/1991 | Schiffer et al. . | |
| 5,114,214 | | 5/1992 | Barman . | |
| 5,956,797 | * | 9/1999 | Wilson | 15/167.1 |
| 5,991,958 | * | 11/1999 | Hohlbein | 15/167.1 |
| 6,066,282 | * | 5/2000 | Kramer | 15/167.1 |
| 6,073,299 | * | 6/2000 | Hohlbein | 15/167.1 |
| 6,101,659 | * | 8/2000 | Halm | 15/167.1 |
| 6,108,849 | * | 8/2000 | Weihrauch | 15/167.1 |

FOREIGN PATENT DOCUMENTS

| | | | | |
|---|---|---|---|---|
| 3 840 136 | | 5/1990 | (DE) . | |
| 3 923 495 | | 1/1991 | (DE) . | |
| 336 641 | | 10/1989 | (EP) . | |
| 604 425 | | 7/1994 | (EP) . | |
| 0 613 636 | | 9/1994 | (EP) . | |
| 0 648 448 | | 4/1995 | (EP) . | |
| 442832 | | 9/1912 | (FR) . | |
| 707727 | | 4/1931 | (FR) . | |
| 1524055 | | 4/1968 | (FR) . | |
| 2 621 466 | | 4/1989 | (FR) . | |
| 2 652 245 | | 3/1991 | (FR) . | |
| 2652245 | * | 3/1991 | (FR) | 15/167.1 |
| 647 916 | | 12/1950 | (GB) . | |
| 673 516 | | 6/1952 | (GB) . | |
| WO 91/19438 | | 12/1991 | (WO) . | |
| WO 93/14671 | | 8/1993 | (WO) . | |
| WO 93/15627 | * | 8/1993 | (WO) | 15/167.1 |
| WO 97 07707 | | 3/1997 | (WO) . | |
| WO 97 25899 | | 7/1997 | (WO) . | |

* cited by examiner

POWER TIP TOOTHBRUSH WITH BALL JOINT

FIELD OF THE INVENTION

This invention relates to toothbrushes, in particular to toothbrushes having a flexibly linked region in their head.

BACKGROUND OF THE INVENTION

Toothbrushes having flexibility-modifying regions in their structure are known, for example WO 92/17092, EP 0613636, EP 0648448A, WO 97/24949 and WO 97/07707. Such flexibility-modifying regions generally comprise forming a composite region of the stiff plastics material of which the toothbrush is made together with a soft flexible elastomer material.

It is believed that optimum flexibility characteristics have not yet been achieved in such toothbrushes, and it is an object of this invention to provide a toothbrush in which the flexibility of the head is further improved, inter alia to enhance the ability of the toothbrush to clean surfaces of the teeth which face the back of the mouth.

SUMMARY OF THE INVENTION

According to this invention a toothbrush comprises a handle and a head, the head having a base end facing the handle and a tip end remote from the base end, a neck region between the base end of the head and the handle, the head adjoining the neck region at the base end of the head, the head, neck and handle being disposed along a longitudinal toothbrush axis, the head having bristles extending from a bristle face of the head, characterised in that:

the head comprises a substantially rigid base region adjoining the toothbrush neck and extending from the base end of the head to a resilient flexible link situated between the base end and the tip end, and a tip region extending from the tip end of the head to the link region, both the base region and tip region being bristle bearing, the tip region being flexibly and resiliently linked at the link region to the base region, and;

between the base end of the head and the neck there is a resilient flexible link.

The handle of a toothbrush is that part of the toothbrush which is grasped by the user whilst brushing his/her teeth. In many toothbrushes the neck is a visually well-defined region between the part of the toothbrush which is grasped, and the head, but in other toothbrushes the head merges relatively imperceptibly into the handle. In general the term "neck" as used herein includes all such possibilities, and specifically that part of the toothbrush which is immediately adjacent to the base end of the head.

The above-described construction of toothbrush concentrates flexibility of the head at the tip end of the toothbrush, and also provides a flexible link between the base end of the head and the handle of the toothbrush.

DETAILED DESCRIPTION OF THE INVENTION

The linking of the tip region and base region is preferably in a manner which enables the tip region to fold or pivot resiliently relative to the base region during toothbrushing. The link provided at the link region between the tip region and the base region allows the tip region to fold or pivot during use about a fold or pivot axis which is generally transverse to the longitudinal toothbrush axis such that bristles on the tip region can lean backwards, i.e. so that the free ends of bristles in the tip region swing toward the handle, assisting the bristles to clean surfaces of the teeth which face the back of the mouth. This fold or pivot axis may be in the plane of the bristle face. The flexible linking provided by this invention between the tip region and base region, and between the head and neck also helps to prevent excessive brushing pressure from being applied during toothbrushing.

The base region is substantially rigid, that is, during the operation of brushing the teeth the base region does not significantly flex beyond the usual limits of flexing of a plastics material toothbrush head. The base region may suitably comprise an integral block of plastics material provided with sockets in which are mounted the tufts of bristles.

The link region is preferably in the longitudinal half of the head furthest from the base of the head. Suitably the base region extends for at least 50%, suitably at least 60%, for example at least 75% of the distance between the base end of the head and the tip of the head.

The tip region may also be substantially rigid, so that the tip region does not itself significantly flex apart from its folding or pivoting relative to the base region. The tip region may suitably comprise an integral block of plastics material provided with sockets in which are mounted the tufts of bristles.

In its non-stressed condition, i.e. when not being used, the bristle face of the tip region and base region of the toothbrush of this invention may be substantially coplanar, i.e. with a substantially 180° angle between them. Alternatively the bristle face of the tip region may form an angle of less than 180° with the bristle face of the base region, e.g. 150°–179°, suitably 155°–170°. In this last-mentioned construction the ends of the bristles on the base region may lie in or about a plane, and the ends of the bristles on the tip region may also lie in or about a plane, and the two respective planes may be coplanar or at an angle, e.g. less than 180° to each other, for example an angle corresponding to the angle between the bristle surfaces of the base region and tip region.

The link between the tip region and the base region in one embodiment of this invention comprises an aperture, space or chasm in the plastics material of which the head is made, between the tip and base regions which is bridged by means of one or more thin links of flexible and resilient plastics material. Such links may comprise thin spines, thin strips, or a continuous thin membrane, made of a both flexible and resilient plastics material, which may be in the same plane as a substantially planar head, or may slope or may be curved out of planarity. The plastics material may be the same plastics material as the tip and base regions but being flexible by virtue of thinness, e.g. the tip, base and bridge(s) may be integrally moulded.

In another embodiment of this invention the link between the tip region and the base region may comprise a composite region having structural elements made of both plastics material and an elastomeric material. For example the composite region may comprise an aperture, space or chasm in the head material between the tip and base regions which is bridged by means of a combination of thin spines, strips or a continuous membrane of a both flexible and resilient plastics material, e.g. integral with the head, and also by an elastomeric material in the aperture, space or chasm. These spines, thin strips or membrane may be in a plane parallel to the plane of the bristle face of the tip region or the base region, or may slope or may be curved or folded out of any parallel relationship with such planes.

Such a composite region may for example comprise a net, ladder, latticework, cellular or trellis structure of plastics material integral with the material of the head, with interstices containing the elastomeric material. Such a composite region may for example comprise one or more, for example two, strips of a plastics material integral with the material of the head, the strips being thinner than the thickness of the head, and extending between the tip region and base region to bridge an aperture, space or chasm between the tip region and the base region, the aperture, space or chasm also containing an elastomeric material, suitably bonded to the sides of the space and to the strips and suitably substantially filling the aperture, space or chasm, optionally also bulging above the surface of the surrounding plastics material of the head.

The plastics material parts in such a composite region may be thick enough to contribute materially to the flexibility and resilience of the link region, or alternatively they may be so thin as to contribute little to the flexibility and resilience of the link region, and may thus serve simply to retain the tip and head regions together before the elastomer is added.

In another embodiment of this invention the link region between the tip region and the base region may comprise an aperture, space or chasm in the head material between the tip and base regions which is bridged solely by means of a complete or partial filling of an elastomeric material. In this construction the head is effectively in two regions with a gap between them containing the elastomer. This elastomeric material is preferably bonded to the tip region and base region on opposite sides of the aperture, space or chasm so as to hold the tip region and base region together.

The above-mentioned apertures or spaces may comprise a slot, chasm or cut out across the width of the head, dividing the base region from the tip region. Such an aperture may be open at the bristle face of the head and/or at the opposite face of the head, and may pass completely through the head. Such apertures, spaces or chasms may be of various shapes, for example widthways slots. These may in plan be substantially straight aligned widthways, curved or angular, e.g. generally "C ", "U" or "V" shaped. In such a construction the convex bulge of the "U" or "C" or the apex of the "V" may point either toward the handle or toward the tip of the head away from the handle. Alternatively such aperture, space or chasms may be narrow at the edges of the head and widen toward the centre of the head or vice versa.

Suitably for example the aperture, space or chasm may comprise one or more, preferably one, grooves with a depth of part of the thickness of the head such that the remaining plastics material at the bottom of the groove forms a thin link of plastics material. The groove may then be filled wholly or partly with elastomeric material to form a composite region.

Alternatively the aperture, space or chasm may pass, in places at least, completely through the thickness of the head, for example leaving bridges of head material crossing the aperture, space or chasm between places where the aperture, space or chasm passes completely through the thickness of the head. Such an aperture, space or chasm may be wholly or partly filled with elastomeric material to thereby form a composite region. When the aperture, space or chasm pass completely through the thickness of the head for the whole of their length they may be wholly or partly filled with an elastomeric material.

The aperture, space or chasm may extend widthways to the sides of the toothbrush head, and elastomeric material therein may be extended around the tip region of the head and/or around the base region of the head to form an elastomeric buffer around the toothbrush head to soften any impact of the toothbrush head with the gums of the user, and also to gently massage the gums. Alternatively elastomeric material may be provided around the tip region of the head to form an elastomeric buffer in a known manner.

When the aperture, space or chasm contains an elastomeric material the outer surface of this elastomeric material may have a corrugated surface, which may further help to control the flexibility of the link region.

In one embodiment of the toothbrush of this invention, the head is constructed such that tip region may fold backwards resiliently relative to the base region, during toothbrushing, about a widthways oriented fold axis that crosses the head in the link region. The fold axis may cross the head in or on the edge of an aperture, space or chasm as described above. In such a construction, the aperture, space or chasm may be shaped such that the widthways oriented fold axis crosses the head of the toothbrush entirely within the aperture, space or chasm. When the link region is a composite region as described above, the folding may occur by bending of the above described plastic material parts, or bending at the point where such a part meets the edge of the aperture, space or chasm.

Such a construction can cause the entire tip region to fold in the bristle direction away from the plane which lies between the bristle face and the opposite face of the head, so that the tip region in effect folds backwards towards the base region during use in toothbrushing.

In an alternative embodiment of the toothbrush of this invention, the tip region and/or link may be constructed and positioned such that the tip region can pivot resiliently relative to the base region during toothbrushing, about a widthways oriented pivot axis that crosses the tip region intermediate between its tip end and its base end.

Such a construction causes pivoting of the tip region about this axis intermediate along its length, i.e. causes the tip region to have a "see-saw" action in which during toothbrushing part of the tip region toward the tip of the head pivots in the bristle direction away from the plane which lies between the bristle face and the opposite face of the head, and the part of the tip region toward the base region of the head pivots in a direction opposite to the bristle direction away from the plane which lies between the bristle face and the opposite face of the head, or vice versa.

In this embodiment such pivoting may for example be achieved in a construction of head in which the tip end of the base region is in the form of two limbs which partly surround a part of the tip region which extends in the base direction between them, with the link between the tip region and the base region. For example the tip end of the base region may be made in the shape of a two pronged fork-like frame, with a part of the tip region between the two prongs of the fork, and a link between the tip region and base region.

In an alternative construction of the head of this embodiment the base end of the tip region may be in the form of two limbs which partly surround a part of the base region which extends in the tip direction between them, with the link between the tip region and the base region. For example the base end of the tip region may be made in the shape of a two pronged fork-like frame, with a part of the base region between the two prongs of the fork, and a link between the tip region and base region.

For example the tip region may be made generally "C", "U" or "V" shaped with its limbs toward the base region, or "Y" shaped with the upper limbs of the Y towards the base region. The part of the base region which extends in the tip direction may lie between the said limbs.

In a construction of head in which the tip end of the base region is in the form of two limbs which partly surround a part of the tip region which extends in the base direction between them, with an aperture between the tip region and the base region, thin links of flexible and resilient plastics material as described above may be provided between the said limbs and the respective tip region. In a construction of head in which the base end of the tip region is in the form of two limbs which partly surround a part of the base region which extends in the tip direction between them, with an aperture between the tip region and the base region, such bridges may be provided between the said limbs and the base region. Suitably in such toothbrushes such bridges may be provided at points widthways diametrically opposite each other to define a pivot axis and to encourage pivoting in a plane in which the longitudinal axis lies. Additionally or alternatively such bridges may be provided at other points in the aperture to encourage pivoting about other axes.

Between the base end of the head and the neck there is a resilient flexible link. In a preferred embodiment this link comprises a composite region of plastics material and an elastomeric material.

In one embodiment this composite region may for example comprise a region of the construction disclosed in WO 92/17092 and EP 0613636 A (the contents of both of which are included herein by way of reference). For example the handle, neck, and head may be integrally made of plastics material and integrally linked between the base end of the head and the handle, and between the neck and the head there may be one or more cut-outs in the plastics material of the head and neck, extending inwardly from the surface of the plastics material, the cut out crossing the boundary between the neck and the head, the cut out containing an elastomeric material different to the plastics material of the head and neck and thereby providing a flexible resilient link between the head and handle.

The said one or more cut-outs may comprise grooves or slots in the plastics material, which contain the elastomeric material, for example one or more longitudinally extending slots.

In such a construction the cut-outs may be such as to form an integral link between the head and neck in the form of a linking narrowed region, e.g. a resilient spine, of the said plastics material, the narrowed being surrounded or laterally flanked by the elastomeric material.

The said cut out may be filled with an elastomeric material up to the full depth of the said cut out. The cut out may extend across the whole width of the toothbrush over at least part of the longitudinal extent of the cut out.

Preferred forms of the above described composite region are as disclosed in WO 92/17092 and EP 0613636 A.

Another embodiment of such a composite region is that disclosed in EP 0648448 A (the contents of which are included herein by way of reference).

A preferred embodiment of such a composite region is that disclosed in WO 97/24949, the contents of which are included herein by reference.

Such a last-mentioned composite region is provided in the toothbrush, which has its head, neck and handle made integrally of plastics material by there being, in the neck region between the base end of the head and the grip handle, an integral thinned part which is of thinned cross section relative to the longitudinally immediately adjacent parts of the neck and/or the head to which it is connected, the said thinned part being laterally surrounded by a mass of elastomeric material bonded to the plastics material.

Preferred forms of this last mentioned composite region are as disclosed in the said WO 97/24949.

Preferably the resilient flexible link between the base of the head and the neck is located at or immediately longitudinally adjacent to the base of the head, and links the head to the neck.

Typically the thinned part may be in the form of a thin spine of the plastics material extending longitudinally between facing surfaces of the said longitudinally adjacent parts of the toothbrush. The thinned part may be of any suitable cross section or overall shape to provide a desired degree or type of flexibility in the neck of the toothbrush. The thinned part may have sides which in the direction of the longitudinal axis of the toothbrush are substantially parallel to the said longitudinal axis. For example the thinned part may be of circular cross section and overall cylindrical shape. Alternatively the thinned part may be of oval, rectangular or capsule-shaped cross section with the long axis of such oval, rectangular or capsule-shape aligned in the same direction as the bristles or perpendicular to the bristles.

Typically the part of the head, e.g. the base end of the head, to which the head end of the thinned part is connected may be of a concave shape, particularly as viewed in plan (i.e. generally perpendicular to the longitudinal direction and generally parallel to the bristle direction) to the deepest part of which the thinned part connects. Alternatively the part of the head to which the head end of the thinned part is connected may be a surface substantially perpendicular to the longitudinal axis.

In such last-mentioned constructions the part of the neck to which the handle end of the thinned part is connected may be of a corresponding convex shape, or may have a surface substantially perpendicular to the longitudinal axis. Alternatively if the part of the head or neck to which the head end of the thinned part is connected is of a concave shape then the part of the head or neck to which the handle end of the thinned part is connected may also be a concave shape of opposite curvature, so as to form a rounded cavity bounded in part at its longitudinal ends by these two respective concave surfaces.

In such constructions the thinned part may in effect bridge a widthways aligned chasm across the neck of the toothbrush, or between the head, e.g. at its base end, and the neck of the toothbrush. The chasm may in effect therefore be a parallel sided slot or a curved sided slot, e.g. with both of its head-end side and handle-end side following a part circular curve. For example the thinned part may be connected at its head end to the base end of the head, the part of the base end of the head to which the head end of the thinned part is connected being of a concave shape, to the deepest part of which the thinned part connects, and the part of the head or neck to which the handle end of the thinned part is connected being of a corresponding convex shape, such that the facing surfaces of the head end of the neck and the base end of the head define a curved chasm between them. Both the facing surfaces of such a curve preferably follow a crescentic curve which is substantially part circular over substantially all its length, with the cusps of the crescent pointing generally toward the handle end of the toothbrush.

As viewed from the side (i.e. from a direction perpendicular to the longitudinal axis and the bristle direction), the said facing surfaces may be aligned substantially perpendicular to the longitudinal toothbrush axis, or may be inclined at a non-perpendicular angle to this axis. For example the surfaces of the chasm between the head end of the neck and the base end of the head may be inclined at an angle such that their extrapolation converges on the bristle surface side of the toothbrush.

The thinned part may bridge the chasm symmetrically relative to the thickness of the toothbrush (i.e. the dimension generally parallel to the bristle direction) or it may be nearer to one or other of the bristle face or the reverse face of the head of the toothbrush for example to cause the link to be more flexible in one flexing direction than in others, or to impart a desired strength or flexibility characteristic to the so-formed link. For example as viewed from the side (i.e. from a direction perpendicular to the longitudinal axis and the bristle direction) the thinned part may be closer to the bristle face than to the reverse face of the head. For example the connection between the thinned part and the base end of the head may be entirely or substantially in the part of the base end of the head and/or neck which is in terms of the thickness of the head and/or neck, in the half nearer to the bristle face of the head and/or neck.

The cross section of the thinned part may for example be 0.1–0.75, suitably 0.25–0.5 of the cross section of the immediately longitudinally adjacent parts of the toothbrush. In a typical toothbrush (toothbrushes are generally all of about the same size), the width of the said chasm (i.e. in the longitudinal direction of the toothbrush) may be ca. 1–5 mm, typically 2–3 mm, at a point where the neck of the toothbrush has a width (i.e. perpendicular to the longitudinal axis and to the bristle direction) of ca. 4–7 mm and a thickness (i.e. perpendicular to the longitudinal axis and parallel to the bristle direction) of 3–5 mm. Suitably therefore the thinned part, e.g. the spine, may be of a relatively short stubby shape with length:width dimensions in the range 2:1 to 1:2, typically 1.5:1 to 1:1.5. A suitable spine may therefore have a width (i.e. across the longitudinal direction of the toothbrush) of ca. 0.4–5 mm, typically about 1–3 mm, and a length corresponding to the above-mentioned width of the chasm it crosses.

Preferably the mass is of a shape which bulges laterally beyond the line of the surface of the longitudinally adjacent parts of the neck or the head to which it is connected. The mass of elastomeric material may suitably be a rounded mass. For example it may have a spherical symmetry, an oblate spherical, ellipsoidal or pear-shaped symmetry etc. Where the above-mentioned chasm is a curved slot the curve of the rounded mass may follow the curve of the chasm. At one or both of the parts of the toothbrush longitudinally adjacent to the mass the plastics material may be enlarged into a mass of a shape, i.e. a curved surface, similar to that, i.e. to the curve, of the mass of elastomeric material, and around which the mass of elastomeric material may be formed. The rounded mass may bulge laterally, in the direction perpendicular to the longitudinal axis of the toothbrush and generally in the bristle direction, to between about 1.5 to 4, e.g. 2 to 3 times the thickness of the immediately adjacent part of the neck and/or the base end of the head. The rounded mass may bulge laterally, in the direction perpendicular to the longitudinal axis of the toothbrush and generally perpendicular to the bristle direction, to between about 1.01 to 1.5, e.g. 1.1 to 1.3 times the width of the immediately adjacent part of the neck and/or the base end of the head.

The elastomeric material in the space may modify the flexibility characteristics of the link, e.g. by providing a flexibility which is part way between that of a wholly plastics material link and a wholly elastomer material link. This may also modify the rocking characteristics of the head relative to the handle.

The plastics material of the toothbrush, and the elastomeric material, whether present in the link between the base and tip regions of the head when this is a composite region, or in the link between the head and neck when this is a composite region, may be plastics and elastomeric material as commonly used in two-component toothbrushes, e.g. that described in EP 0336641, which can be bonded to plastics materials used for toothbrush handle manufacture. Such an elastomeric material can be injected into the toothbrush mould shortly after injection moulding of the plastics material parts of the toothbrush so that the hot plastics material fuses and bonds with the elastomeric material. This is a generally known process.

Suitable plastics materials include, for example, polyamides and polypropylenes. An example of a suitable polyamide is the material 'Ultramid B3™' (marketed by BASF, Federal Republic of Germany), having a modulus of elasticity (DIN 53452) of 3000. An example of a suitable polypropylene is the material 'Novolene 1100 HX™' (marketed by BASF, Federal Republic of Germany), which is a homopolymer and has a modulus of elasticity (DIN 53457) of 1400. Such a polypropylene homopolymer may optionally be used in admixture with a polypropylene block co-polymer, such as the material 'Novolene 2500 HX™' (marketed by BASF, Federal Republic of Germany), for example in an 80:20 mixture by weight (1100 HX:2500 HX). Suitable elastomeric materials include natural or synthetic latex type elastomers, in particular polychloroprene, natural rubber and silicones, for example the elastomeric material Santoprene™.

The toothbrush of the invention may be made by generally conventional injection moulding techniques, for example in which a plastics material "skeleton" is first made by injection moulding, then elastomer parts if present, are introduced by a subsequent injection moulding step, in which the elastomer is injected as a hot fluid and bonds to the plastics material. A suitable, self evident, injection moulding process by means of which toothbrushes can be made having elastomeric materials disposed at separated places on a plastics material is disclosed in WO 94/05183.

The bristles may also be of generally conventional construction, arrangement on the bristle face, and materials, and may be fastened into the bristle face by generally known techniques.

DESCRIPTION OF THE FIGURES

The invention will now be described by way of example only with reference to the accompanying figures which show:

Referring to FIGS. 1 to 6, a toothbrush 1 (overall) is shown which comprises a handle 2 and a head 3. The head has a base end 4 facing the handle 2 and a tip end 5 remote from the base end 4. There is a neck 6 between the base end 4 of the head 3 and the handle 2. The head 3 adjoins the neck 6 at the base end 4 of the head 3. The head 3, neck 6 and handle 2 are disposed along a longitudinal toothbrush axis A—A. Tufts 7 of bristles, mounted in socket holes 8, extend from a bristle face 9 of the head 3.

Figure 1:
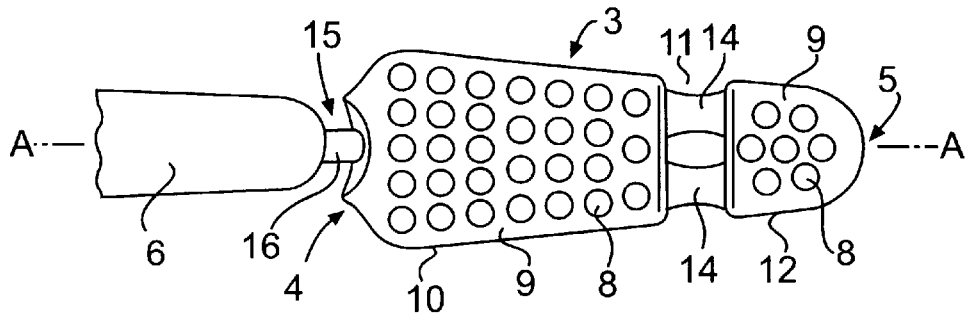
FIG. 1 A plan view of the plastics material parts of the head and neck of a toothbrush of this invention.
Figure 2:
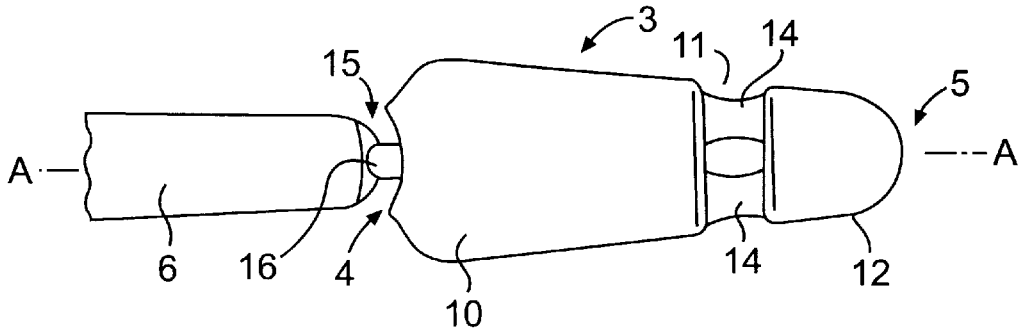
FIG. 2 An underside view of the plastics material parts of the head and neck of a toothbrush of this invention.
Figure 3:
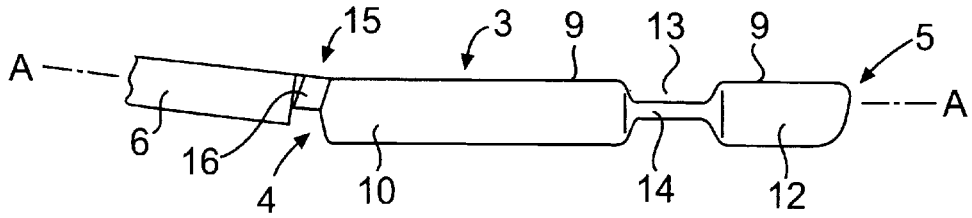
FIG. 3 A side view of the plastics material parts of the head and neck of a toothbrush of this invention.

The head 3 comprises a substantially rigid base region 10 adjoining the toothbrush neck 6 and which extends from the base end 4 of the head 3 to a link 11 situated between the base end 4 and the tip end 5, and a tip region 12 extending from the tip end 5 of the head 3 to the link 11. Both the base region 10 and the tip region 12 bear bristles 7 (omitted for clarity in FIGS. 1–5).

The link region 11 is provided by a chasm 13 between the tip region 12 and the base region 10 which is bridged by two strips 14 of a plastics material integral with the material of the head 3, the strips 14 being thinner than the thickness of the head 3, and extending between the tip region 12 and the base region 10 to bridge the chasm 13. The strips 14 are considerably thinner than the thickness of immediately adjacent parts 10,12 of the head 3, so as to provide a flexible link.

Between the base end 4 of the head 3 and the neck 6 there is a link 15, being in the form of a resilient flexible composite region 15 of plastics material and elastomeric material.

This resilient flexible composite region 15 comprises an integral thinned part 16 connected at one of its ends to the neck 6 and at the other of its ends to the base end 4 of the head 3. The part 16 is of thinned cross section relative to the longitudinally adjacent parts of the neck 6 and the head 3 to which it is connected. The part 16 is in the form of a thin spine of the plastics material, of generally oval cross section across the longitudinal axis A—A, the long axis of the oval being aligned generally in the bristle direction, extending longitudinally between the base end 4 of the head 3 and neck 6. The thinned part 16 bridges a widthways aligned chasm 17 in the form of a curved sided slot across the neck of the toothbrush, between the base end 4 of the head 3, and the neck 6 of the toothbrush.

Figure 4:
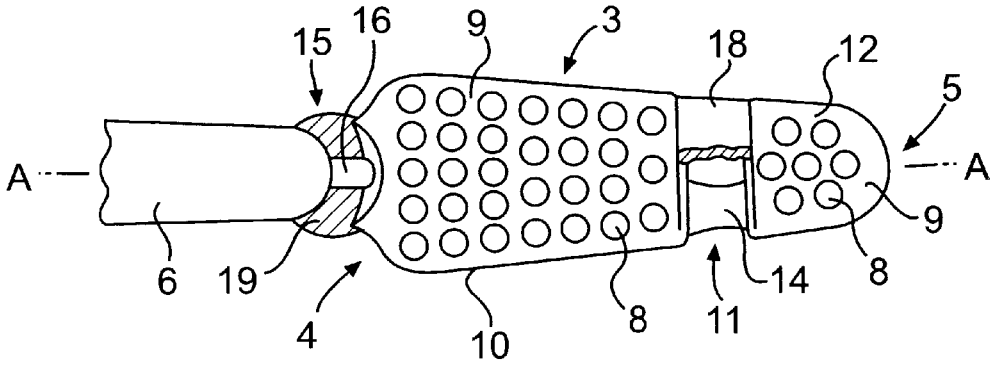
FIG. 4 A plan part cutaway view of the toothbrush head of FIG. 1 showing the elastomer material in place.
Figure 5:
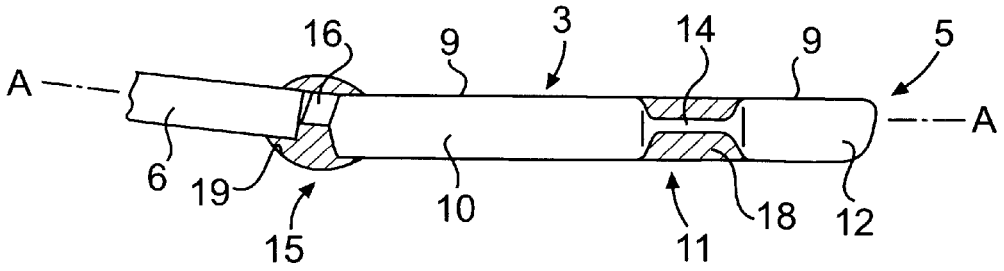
FIG. 5 A sectional view of the toothbrush head of FIG. 3 showing the elastomer material in place.
Figure 6:
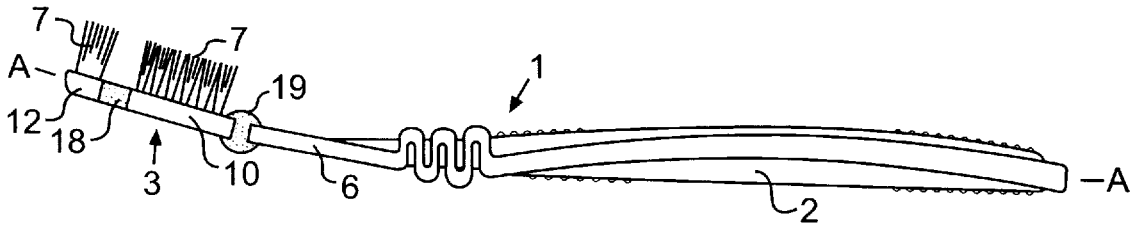
FIG. 6 A side view of a toothbrush of this invention including elastomeric material and bristles.

As shown in FIGS. 4, 5 and 6 the chasm 13 is filled with an elastomeric material 18, which surrounds and encases the strips 14. The chasm 17 is also filled with an elastomeric material 19, so that the thinned part 16 is laterally surrounded by a mass 19 of elastomeric material, which is bonded to the plastics material, and is of a shape which bulges generally spherically laterally beyond the line of the surface of the longitudinally adjacent parts of the neck 6 and the head 3 to which it is connected. This elastomeric material is shown part cutaway in FIGS. 4 and 5 to show more clearly how the strips 14 and part 16 are embedded in the elastomeric material.

As shown in FIGS. 1–6, the bristle faces 9 of the base region 10 and the tip region 12 are in the same plane. In the embodiment shown in FIG. 7 the bristle faces 9 of the base region 10 and the tip region 12 are at an angle of less than 180° to each other, so that these respective bristle faces 9 are not in the same plane. The ends of the bristles on the base region lie in a plane, and the ends of the bristles on the tip region also lie in a plane, the two planes not being coplanar but at an angle to each other corresponding to the angle between the bristle faces 9 of the base region 10 and tip region 12. By the construction shown in FIG. 7 the tips of the bristles are advantageously angled for cleaning around the surfaces of the teeth, but also the gap 20 between the ends of the bristles 7 of the base region 10 and of the tip region 12 is minimised.

Figure 7:
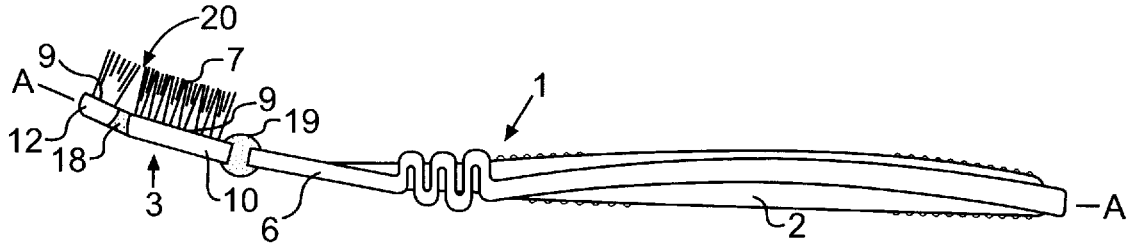
FIG. 7 A side view of another embodiment of toothbrush of this invention.

It will be apparent from FIGS. 1–5 that the internal construction of the toothbrush of FIG. 7 is similar. The angle between the base region 10 and tip region 12 is achieved by applying a corresponding angle to the plastic material parts of the toothbrush, e.g. by forming such an angle in the plastic parts of the toothbrush as moulded, or moulding the plastic parts and then bending the plastic parts through the appropriate angle, before injecting the elastomer material 18, to thereby set the toothbrush with the indicated angle between the base region 10 and tip region 12.

Figure 8:
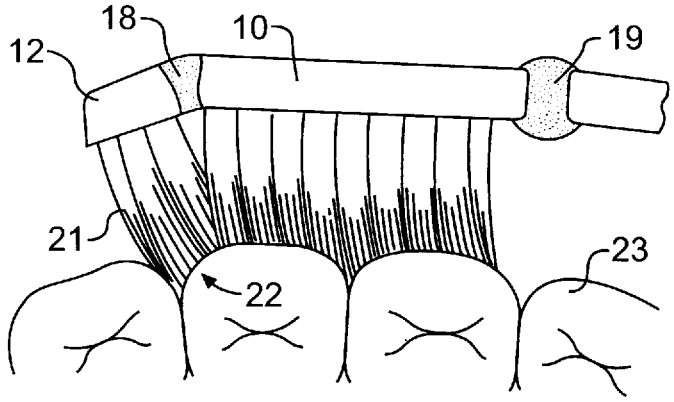
FIG. 8 The toothbrush of this invention in action, cleaning the teeth.

Referring to FIG. 8 it is seen that the bristles 21 of the tip region 12 of the toothbrush of the invention, particularly that of FIG. 7, advantageously reach the rear-facing surfaces 22 of the teeth 23 of the user.

Figure 9:
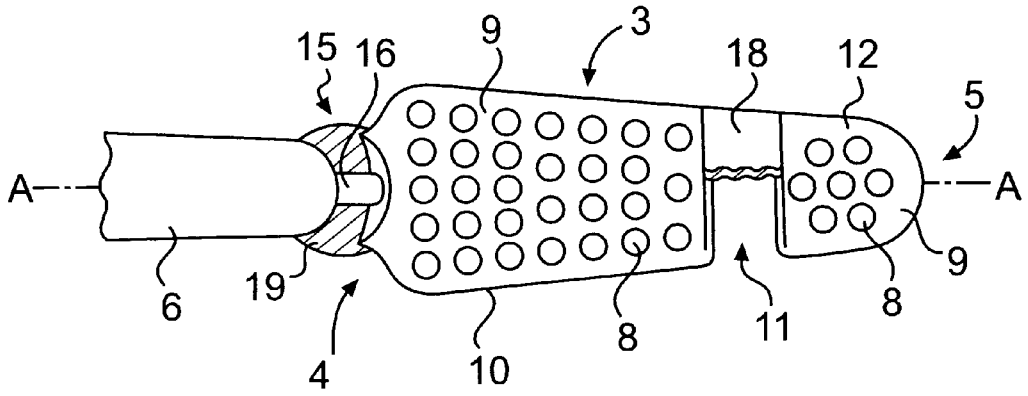
FIG. 9 A plan part cutaway view of another embodiment of this invention.
Figure 10:
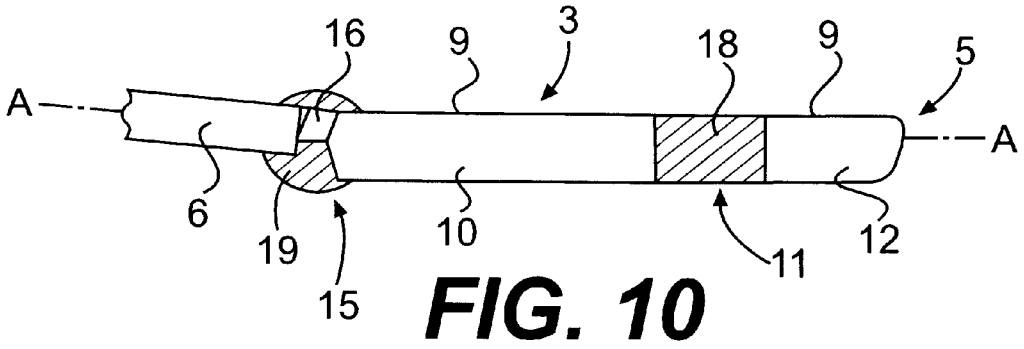
FIG. 10 A sectional view of another embodiment of this invention.

Referring to FIGS. 9 and 10, depicting another embodiment of this invention wherein the link region 11 between the tip region 12 and the base region 10 may comprise an aperture, space or chasm in the head material between the tip 12 and base 10 regions which is bridged solely by means of a complete or partial filling of an elastomeric material 18.

What is claimed is:

1. A toothbrush comprising a handle and a head, the head having a base end facing the handle and a tip end remote from the base end, a neck region between the base end of the head and the handle, the head adjoining the neck region at the base end of the head, the head, neck and handle being disposed along a longitudinal toothbrush axis, the head having bristles extending from a bristle face of the head, characterized in that:

the head comprises a substantially rigid base region adjoining the toothbrush neck and extending from the base end of the head to a resilient flexible link situated between the base end and the tip end, and a tip region extending from the tip end of the head to the link region, both the base region and tip region being bristle bearing, the tip region being flexibly and resiliently linked at the link region to the base region; and between the base end of the head and the neck there is a resilient flexible link, wherein the base region of the head extends at least 60% of the distance between the base end of the head and the tip end of the head.

2. A toothbrush according to claim 1 characterised in that the linking of the tip region and base region is in a manner which enables the tip region to fold or pivot resiliently relative to the base region during toothbrushing.

3. A toothbrush according to claim 1 characterised in that the tip region is also substantially rigid.

4. A toothbrush according to claim 1 characterised in that in its non-stressed condition the bristle face of the tip region and base region of the toothbrush are substantially coplanar.

5. A toothbrush according to claim 1 characterised in that in its non-stressed condition the bristle face of the tip region and base region of the toothbrush form an angle of less than 180°.

6. A toothbrush according to claim 1 characterised in that the link between the tip region and the base region comprises a composite region having structural elements made of both plastics material and an elastomeric material.

7. A toothbrush according to claim 6 characterised in that the composite region comprises an aperture, space or chasm in the head material between the tip and base regions which is bridged by means of a combination of thin spines, strips or a continuous membrane of a both flexible and resilient plastics material integral with the head, and also by an elastomeric material in the aperture, space or chasm.

8. A toothbrush according to claim 7 characterised in that the composite region comprises one or more strips of a plastics material integral with the material of the head, the strips being thinner than the thickness of the head, and extending between the tip region and base region to bridge an aperture, space or chasm between the tip region and the base region, the aperture, space or chasm also containing an elastomeric material, bonded to the sides of the space and substantially filling the aperture, space or chasm.

9. A toothbrush according to claim 1 characterised in that the link between the tip region and the base region comprises an aperture, space or chasm in the plastics material of which the head is made, between the tip and base regions which is bridged by means of one or more thin links of flexible and resilient plastics material.

10. A toothbrush according to claim 1 characterised in that the link region between the tip region and the base region comprises an aperture, space or chasm in the head material between the tip and base regions which is bridged solely by means of a complete or partial filling of an elastomeric material.

11. A toothbrush according to claim 1 characterised in that the head is constructed such that tip region may fold backwards resiliently relative to the base region, during toothbrushing, about a widthways oriented fold axis that crosses the head in the link region.

12. A toothbrush according to claim 1 characterised in that the tip region and/or link are constructed and positioned such that the tip region can pivot resiliently relative to the base region during toothbrushing, about a widthways oriented pivot axis that crosses the tip region intermediate between its tip end and its base end.

13. A toothbrush according to claim 1 characterised in that the resilient flexible link between the base end of the head and the neck comprises a composite region of plastics material and an elastomeric material.

14. A toothbrush according to claim 13 characterised in that the link between the head and neck is in the form of a linking narrowed region of the said plastics material, the narrowed being surrounded or laterally flanked by the elastomeric material.

15. A toothbrush according to claim 13 characterised in that the composite region comprises an integral thinned part which is of thinned cross section relative to the longitudinally immediately adjacent parts of the neck and/or the head to which it is connected, the said thinned part being laterally surrounded by a mass of elastomeric material bonded to the plastics material.

16. A toothbrush according to claim 13 characterised in that the resilient flexible link is located at or immediately longitudinally adjacent to the base of the head, and links the head to the neck.

* * * * *